US007624788B2

(12) United States Patent
Brown et al.

(10) Patent No.: US 7,624,788 B2
(45) Date of Patent: Dec. 1, 2009

(54) HEAT EXCHANGER

(75) Inventors: George Zindel Brown, Eugene, OR (US); Thomas Dale Northcutt, Springfield, OR (US); Jeffrey Alan Kline, Eugene, OR (US)

(73) Assignee: State of Oregon acting by and through the State Board of Higher Education on Behalf of The University of Oregon, Eugene, OR (US)

( * ) Notice: Subject to any disclaimer, the term of this patent is extended or adjusted under 35 U.S.C. 154(b) by 770 days.

(21) Appl. No.: 10/999,604

(22) Filed: Nov. 29, 2004

(65) Prior Publication Data

US 2005/0236138 A1 Oct. 27, 2005

Related U.S. Application Data

(60) Provisional application No. 60/564,702, filed on Apr. 22, 2004.

(51) Int. Cl.
*F28F 7/00* (2006.01)

(52) U.S. Cl. ..... 165/83; 165/46; 165/47; 165/48; 165/81; 165/82; 165/66; 165/901; 165/905; 165/154; 138/93; 138/112; 138/114; 383/3; 206/522

(58) Field of Classification Search ..... 165/47, 165/48.1, 81–83, 901, 905, 154, 46, 141, 165/66; 138/93, 112, 114; 383/3; 206/522
See application file for complete search history.

(56) References Cited

U.S. PATENT DOCUMENTS 3,667,625 A * 6/1972 Lucas ..... 410/119
4,007,781 A 2/1977 Masters
4,138,288 A 2/1979 Lewin
4,164,970 A * 8/1979 Jordan ..... 383/3
4,213,498 A 7/1980 Vandenbossche
4,228,848 A 10/1980 Wadkinson, Jr.
4,232,735 A 11/1980 Kim et al.
4,377,201 A 3/1983 Kruse et al.
4,377,400 A 3/1983 Okamoto et al.
4,393,666 A 7/1983 Revis
4,512,393 A 4/1985 Maendel
4,550,773 A 11/1985 Martin
4,653,575 A 3/1987 Courchesne
4,872,503 A 10/1989 Marriner
4,993,484 A 2/1991 Neuzil
5,035,236 A 7/1991 Kanegaonkar (Continued)

OTHER PUBLICATIONS

Brown, G.Z. et al., "Attic and Crawl Space Ventilation Air Heat Exchanger," pp. 1-12 (May 10, 2001).

(Continued)

*Primary Examiner*—Frantz F Jules
*Assistant Examiner*—Azim Rahim
(74) *Attorney, Agent, or Firm*—Klarquist Sparkman, LLP

(57) ABSTRACT

A heat exchanger according to certain embodiments includes an outer portion formed of at least one inflatable cell and an inner portion. The inflatable cell has inner and outer surfaces that are separated from each other and at least partially support the outer portion when inflated. The outer portion defines a first interior passage configured to convey fluid. The inner portion is positioned within the outer portion, the inner portion defining a second interior passage configured to convey fluid.

11 Claims, 10 Drawing Sheets

U.S. PATENT DOCUMENTS

| | | | |
|---|---|---|---|
| 5,251,692 | A | 10/1993 | Haussmann |
| 5,251,693 | A | 10/1993 | Zifferer |
| 5,327,957 | A | 7/1994 | Killebrew |
| 5,327,958 | A | 7/1994 | Machata et al. |
| 5,385,299 | A | 1/1995 | Zawada |
| 5,406,933 | A | 4/1995 | Lu |
| 5,406,934 | A | 4/1995 | Cain |
| 5,423,374 | A | 6/1995 | Miller et al. |
| 5,425,415 | A | 6/1995 | Master et al. |
| 5,447,194 | A | 9/1995 | Hayashi et al. |
| 5,447,195 | A | 9/1995 | Luyts |
| 5,477,846 | A | 12/1995 | Cameron |
| 5,518,067 | A | 5/1996 | Finch et al. |
| 5,575,835 | A | 11/1996 | Bailey et al. |
| 5,702,296 | A | 12/1997 | Grano |
| 5,722,483 | A | 3/1998 | Gibson |
| 5,759,712 | A | 6/1998 | Hockaday |
| 5,931,017 | A | 8/1999 | Kanninen et al. |
| 6,013,385 | A | 1/2000 | DuBose |
| 6,248,153 | B1 | 6/2001 | Braun et al. |
| 6,273,180 | B1 | 8/2001 | Joshi et al. |
| 2001/0032714 | A1 | 10/2001 | Haglid |
| 2001/0042610 | A1 | 11/2001 | Lyons et al. |
| 2004/0134553 | A1 * | 7/2004 | Ichimura et al. ..... 138/114 |

OTHER PUBLICATIONS

Dieckmann, J. et al., "Air-To-Air Energy Recovery Heat Exchangers," *ASHRAE Journal*, pp. 57-58 (Aug. 2003).

Brown, G.Z., "Attic and Crawl Space Ventilation Air Heat Exchanger," California Energy Commission (CEC) Energy Innovations Small Grant (EISG) Program, http://eisg.sdsu.edu/..\Fullsums\99-24.htm (Printed Apr. 8, 2003).

Venmar/VänEE, Models 1.3 HE and 1000 HE, Product Sheet #90293 (Apr. 2003).

Venmar/VänEE, Models 1.8 HE and 2000 HE, Product Sheet #90295 (Apr. 2003).

Venmar/VänEE, Models 2.6 HE and 3000 HE, Product Sheet #90297 (Apr. 2003).

Venmar/VänEE, Model 90H Bronze Series, Product Sheet #90219 (Apr. 2003).

Venmar/VänEE, Model 1001 ERV Gold Series, Product Sheet #90198 (Feb. 2002).

Venmar/VänEE, Model 2001 ERV Gold Series, Product Sheet #90199 (Feb. 2002).

Venmar/VänEE AVS Solo Heat Recovery Ventilator, http://frontpage.thermalassociates.com/solo.html (Printed Aug. 12, 2003).

* cited by examiner

°F DEGREES FAHRENHEIT

% RELATIVE HUMIDITY

°F DEGREES FAHRENHEIT

% RELATIVE HUMIDITY

HEAT EXCHANGER

RELATED APPLICATIONS

This application claims priority from U.S. Provisional Patent Application No. 60/564,702, filed Apr. 22, 2004, which is incorporated herein by this reference.

FIELD

The present disclosure relates to a heat exchanger. Exemplary embodiments of the heat exchanger can be used, for example, as part of a ventilation system in a building or house.

BACKGROUND

As a result of improved construction techniques and materials, residential and commercial buildings are becoming increasingly sealed from the outdoor environment. Because of inadequate ventilation in such buildings, the indoor air can contain a variety of substances that pose a health risk to its occupants. For example, the air may contain a build up of carbon dioxide, carbon monoxide, and volatile organic compounds. Consequently, there is a trend toward increasing the use of ventilation systems in order to improve indoor air quality. Increased ventilation, however, can significantly increase the heating and cooling loads on a building's heating, ventilation, and air-conditioning (HVAC) system. For example, dwelling ventilation is thought to account for 33% to 50% of the space-conditioning energy used in the 75 million single-family households in the United States. This amounts to around 1.6 exajoules of energy (or 262 million barrels of oil) at an operating cost of about $4 billion annually.

To reduce the load of a building's HVAC system, conventional ventilation systems sometimes use compact heat exchangers to temper incoming outdoor air with exhaust air. These heat exchangers are sometimes referred to as enthalpy recovery heat exchangers or energy recovery heat exchangers, which belong to the class of equipment known as heat recovery ventilators (HRVs) or energy recovery ventilators (ERVs). By using a heat exchanger in connection with a ventilation system, incoming outdoor air can be pre-cooled (during cooling season) or pre-heated (during heating season), thereby reducing the sensible portion of air conditioning and heating loads. If the heat exchanger can transfer latent heat in addition to sensible heat (i.e., a total enthalpy heat exchanger), the latent portion of cooling and heating loads (dehumidification and humidification, respectively) can similarly be reduced.

Conventional heat exchangers typically use finned-tubes, enthalpy wheels, or heat pipes to help increase the heat transfer between the incoming and outgoing airflows. The heat exchange surface of such conventional designs is ordinarily made from a material having a relatively high thermal conductivity, such as aluminum, copper, or steel. Moreover, conventional heat exchangers are designed to fit in confined areas near to or within a building's heating, ventilation, and air-conditioning (HVAC) unit without sacrificing any efficiency. For these reasons, conventional heat exchangers tend to be too expensive for most building applications. Accordingly, there is a need for a lower cost alternative heat exchanger.

SUMMARY

In view of the issues and concerns described above, various embodiments of a heat exchanger are described herein. The features and aspects of the disclosed embodiments can be used alone or in various novel and unobvious combinations and sub-combinations with one another.

In one embodiment, a heat exchanger having an outer portion formed by at least one inflatable cell is disclosed. The one or more inflatable cells have inner and outer surfaces that are separated from each other and that at least partially support the outer portion when inflated. The outer portion further defines a first interior passage configured to transport fluid, such as air. An inner portion is positioned within the outer portion and further defines a second interior passage also configured to transport fluid. The inner portion may be formed of a vapor-permeable material capable of transmitting latent and sensible heat. The outer portion may form a generally cylindrical outer tube having a closed periphery and can be constructed at least partially of a nonpermeable polymer. In one implementation, multiple inflatable cells of the outer portion are in at least partial fluid communication with one another. For instance, the ends of the inflatable cells may be fluidly coupled via a collar portion or manifold. The collar portion or manifold may be coupled to an air source (e.g., an HVAC unit) used to maintain the cells in an inflated state. The inner portion may also be disposed concentrically within the outer portion and supported by a support structure in the first inner passage. In some embodiments, the heat exchanger further comprises a mechanism for introducing moisture or vapor into the outer passage.

In another embodiment, a heat exchanger having an enclosed outer portion formed of a collapsible material is disclosed. An inner portion is positioned within the outer portion, and the inner portion is at least partially constructed of a thin membrane capable of transmitting at least sensible heat. A space between the outer and inner portions defines an outer passage that is configured to transport air in a first direction. A separate interior passage configured to transport air in an opposite direction is defined by the inner portion. In this embodiment, the outer portion and the inner portion are dimensioned to create a flow friction that is less than or equal to 0.05 inches of water per one-hundred feet of path length in the heat exchanger. In certain implementations, the flow friction is less than 0.03 inches of water per one-hundred feet of path length. In another implementation, the smallest dimension in a cross-section of the interior passage is greater than two inches. The heat exchanger may further include any of the various features described in the previous embodiment.

In yet another embodiment, a heat exchanger having an outer tube substantially constructed from a flexible, nonpermeable polymer is disclosed. An inner tube substantially constructed from a vapor-permeable material and positioned within the outer tube is also disclosed. The inner tube defines an interior passage configured to convey fluid in a first direction, whereas an annular passage defined between the inner tube and the outer tube is configured to convey fluid in a second direction opposite the first direction. The outer tube and the inner tube may be constructed or coupled to an air source in any of the various manners described above. The heat exchanger may further include any of the various features described above.

A method of utilizing unused space in a building for exchanging heat is also disclosed. According to the method, a tube-in-tube heat exchanger with inner and outer tubes is provided. The outer tubes are formed of multiple inflatable air cells. An end of the inner tube is connected to an inlet of a ventilation system for the building. An end of the outer tube is connected to an outlet of the ventilation system. The air cells of the tube-in-tube heat exchanger are inflated in an unused space in the building. When connecting the end of the outer tube, a valve fluidly coupled to the multiple air cells (e.g., a one-way valve) may also be connected to the outlet of the ventilation system. The unused space may be, for example, an attic or crawlspace. Further, the outer tube may be constructed of a nonpermeable material, whereas the inner tube may be constructed of a vapor-permeable membrane. The inflatable air cells of the outer tube can be inflated each time the ventilation system is activated. Further, a smallest dimension in a cross-section of the inner tube can be greater than two inches when the inner tube is inflated. The inner tube may be positioned substantially concentrically within the outer tube and may be supported within the outer tube by a support structure.

The foregoing and additional features of the disclosed technology will be more readily apparent from the following detailed description, which proceeds with reference to the accompanying drawings.

DETAILED DESCRIPTION

Disclosed below are representative embodiments that should not be construed as limiting in any way. Instead, the present disclosure is directed toward novel and nonobvious features and aspects of the various embodiments of the heat exchanger described below. The disclosed features and aspects can be used alone or in novel and nonobvious combinations and sub-combinations with one another.

The disclosed embodiments can be applied in a variety of fields or environments where the use of a heat exchanger is desirable. For example, in one of the described embodiments, the heat exchanger is used in connection with a building's ventilation system that takes in outdoor air while exhausting indoor air. The described embodiments may also be used, among other things, as part of an HVAC system, evaporative cooler system, a filtration system, or as part of a cooling, heating, ventilation, or filtration system for industrial applications (e.g., ventilation or filtration for an industrial kiln).

Figure 1:
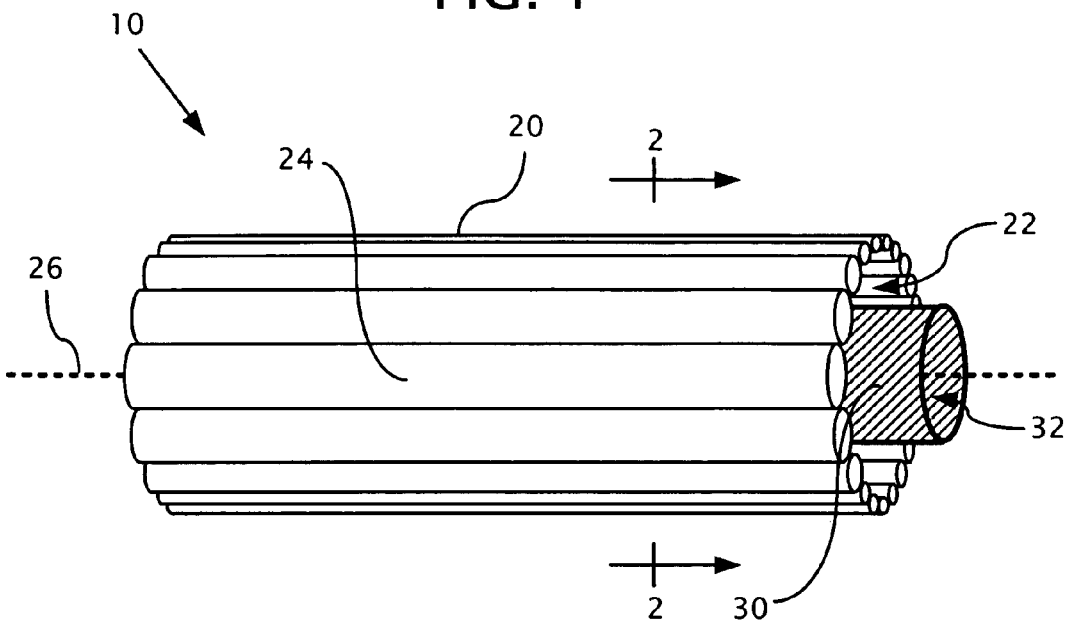
FIG. 1 is a schematic perspective view of a main-body portion of a representative heat exchanger.

FIG. 1 shows a perspective view of a main-body portion 10 from one representative embodiment of the disclosed heat exchanger. In the illustrated embodiment, an outer tube 20 defines a generally cylindrical cavity that encloses an inner tube 30, thereby forming an annular outer passage 22. The outer tube 20 of this exemplary embodiment comprises an inflatable membrane that lends structure and support to the outer tube when inflated and that collapses when deflated. For instance, as is shown in FIG. 1, the outer tube may comprise multiple inflatable cells (shown generally at cell 24) that extend along the longitudinal axis 26 of the main-body portion 10. When the cells 24 are inflated, the outer tube 20 assumes its cylindrical form, thereby increasing the volume of air that may pass through the outer passage 22 of the main-body portion 10. When inflated, the outer tube 20 may still retain some flexibility, thereby allowing it to be shaped and bent according to a particular application or environment. In some embodiments, the inflatable membrane does not provide the principal support for the outer tube 20, but does create an insulative layer between the interior of the annular outer passage 22 and the exterior of the outer tube 20. In still other embodiments, the outer tube 20 does not comprise an inflatable membrane.

In general, the outer tube 20 may be constructed from a number of suitable materials that are nonpermeable and exhibit at least some flexibility. For some embodiments, it is desirable for the outer tube 20 to be easily collapsible. For example, in one particular embodiment, the outer tube 20 is formed of a low-cost, non-metallic material, such as a nonpermeable plastic (including, but not limited to, suitable polymers such as polyethylene, polyisoprene, polyisobutylene, polyvinyl chloride, polypropylene, polyester, nylon, and similar polymers). As noted, the outer tube 20 need not be inflatable, and may define the outer passage 22 using other means of support. For example, the output tube may comprise a variety of support structures placed continuously or intermittently along the inner surface of the tube 20 (e.g., a helical wire support structure).

As shown in FIG. 1, the inner tube 30 is enclosed by the outer tube 20. The inner tube 30 may be positioned concentrically within the outer tube 20. Alternatively, the inner tube 30 may be located in an off-axis position. An inner passage 32 defined by the interior of the inner tube 30 is termed, for purposes of this disclosure, the "inner-tube passage." Similarly, the annular outer passage 22 defined between the interior of the outer tube 20 and the exterior of the inner tube 30 is termed the "outer-tube passage." The inner tube 30 shown in FIG. 1 has a generally cylindrical shape and, in certain embodiments, is constructed of a vapor-permeable material. For instance, the inner tube 30 may be constructed of a thin-film non-metallic water-vapor-permeable membrane, such as the material sold under the Tyvek® brand name. Tyvek® material is sometimes described as a spunbonded olefin. Of course, other similar vapor-permeable materials could also be used. Using such vapor-permeable material makes the inner tube 30 resistant to air, allowing it to reliably propagate a column of air, but permeable to water vapor, which allows exchange of vapor between the inner-tube passage 32 and the outer-tube passage 22.

In other embodiments, however, the inner tube 30 is constructed from a thin material that is capable of transmitting just sensible heat (e.g., ultra-high molecular-weight (UHMW) polyethylene or any of the polymers discussed above with respect to the outer tube). As discussed below with respect to FIG. 13, such materials typically have a low coefficient of heat transfer relative to materials used for the heat-exchange surface of conventional heat exchangers. However, because of the flexibility that is allowed in certain embodiments of the disclosed heat exchanger, the inner tube 30 can be relatively thin, thereby increasing the coefficient of heat transfer.

In one exemplary implementation, the inner-tube passage 32 carries exhaust air out of an enclosed environment, whereas the outer-tube passage 22 carries fresh inlet air into the enclosed environment (e.g., a room of a building or house). The alternating directions of the airflow create a counterflow between the two passages 22, 32. Further, because the inner tube 30 can, in some embodiments, be formed of a water-vapor-permeable material, the main-body portion 10 can operate substantially as a total enthalpy heat exchanger, which is capable of transferring both sensible and latent heat. More particularly, sensible heat, which is associated with a change in temperature of the air traveling through the passages 22, 32, is exchanged via conduction between the inner-tube passage 32 and the outer-tube passage 22. Latent heat, which is associated with the heat required to change the state of a substance, is exchanged when water vapor (e.g., from humidity in the air) passes between the inner-tube passage 32 and the outer-tube passage 22.

The exchange of water vapor between the inner-tube passage 32 and the outer-tube passage 22 can offer several advantages in a heat exchange system. For example, if the heat exchanger is being used as part of a ventilation system for a building or house, the exchange of water vapor helps maintain the humidity in the interior climate from the exterior climate. For example, during dry winter conditions, moisture in the exhaust air will be transferred into the dry inlet air, thereby keeping the humidity of the air in the building or house at a comfortable level. Similarly, during summer conditions, moisture in the inlet air is transferred to the drier exhaust air, thereby preconditioning the inlet air. As discussed below, the performance of the heat exchanger may be enhanced by introducing moisture to the air in one or more of the passages in the heat exchanger.

Figure 2:
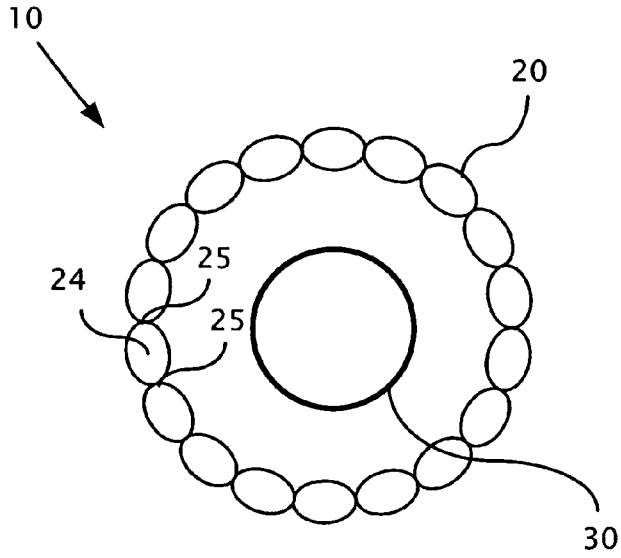
FIG. 2 is a cross-sectional view of the main-body portion in FIG. 1 taken along its longitudinal axis.

FIG. 2 shows a cross-section of the main-body portion 10 taken generally along the line 2-2. In the exemplary embodiment shown in FIG. 2, the cells 24 of the outer tube 20 form individual, elliptical-shaped chambers having an outer surface and an inner surface that are joined to one another at some point along their peripheries, shown generally as edge 25. In the embodiment shown in FIG. 2, the interiors of the cells 24 are not in fluid communication with one another. The embodiment shown in FIG. 2 also has a concentrically positioned inner tube 30.

The outer tube 20 and the inner tube 30 shown in FIGS. 1 and 2 may have a variety of different dimensions. The lengths and diameters of the tubes 20, 30 are largely dependant on the enclosed space in which the heat exchanger is placed. In certain embodiments, the inner tube 30 of the heat exchanger has a "passage height" greater than two inches. For purposes of this disclosure, the "passage height" is defined as the smallest dimension in a cross-section of a particular passage. For example, if the passage is ellipsoidal along its cross-section, the passage height is equal to the length of the ellipse along its minor axis. It has been observed that the embodiments of the heat exchanger having a passage height greater than two inches exhibit low friction flow in comparison to conventional heat exchangers. For example, certain embodiments of the heat exchanger having passage heights of 4, 5, 6, and 7 inches have a friction loss (sometimes referred to as flow friction) measured in inches of water per one-hundred feet of path length of about 2.25, 0.75, 0.3, and 0.07, respectively. By contrast, conventional heat exchangers have a passage height between about 0.1 and 0.2 inches (a full magnitude of order less than the embodiments described above), and exhibit substantially higher friction losses. In certain embodiments, the increased passage height increases the turbulent airflow within the passages 22, 32. This turbulent airflow can consequently produces greater heat exchange between the two passages 22, 32. A comparison of the passage height of conventional heat exchangers with an exemplary embodiment of the disclosed heat exchanger is shown below in Table 2.

The configurations shown in FIGS. 1 and 2 are not limiting, and various alternative configurations are possible. For instance, the cells 24 may be fluidly connected with one another in the main-body portion 10. Similarly, any number of inflatable chambers may be used to form the outer tube, including just one chamber. Moreover, the outer tube 20 and the inner tube 30 may have a variety of different shapes. For instance, the outer tube 20 and/or the inner tube 30 may have, for example, a square, triangular, polygonal, or elliptical shape. Moreover, the shapes of the outer tube and the inner tube do not need to match. Further, multiple inner tubes may be present within the outer tube. Similarly, the cells 24 of the outer tube need not have a particular shape, but can instead have a variety of configurations. For example, any one or multiple ones of the cells 24 may be square, triangular, polygonal, or elliptical. Moreover, the cells 24 need not extend along the longitudinal axis of the outer portion, but may, for example, form a series of ring cells that define the outer tube. In still other embodiments, the outer tube contains no inflatable portion and is entirely supported by some internal or external support structure.

Figure 3:
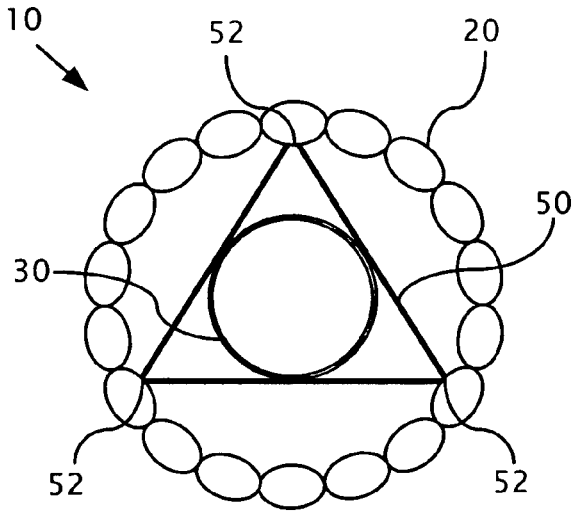
FIG. 3 is a cross-sectional view of the main-body portion in FIG. 1 illustrating a first representative embodiment of a support structure for supporting the inner tube within the outer tube.
Figure 4:
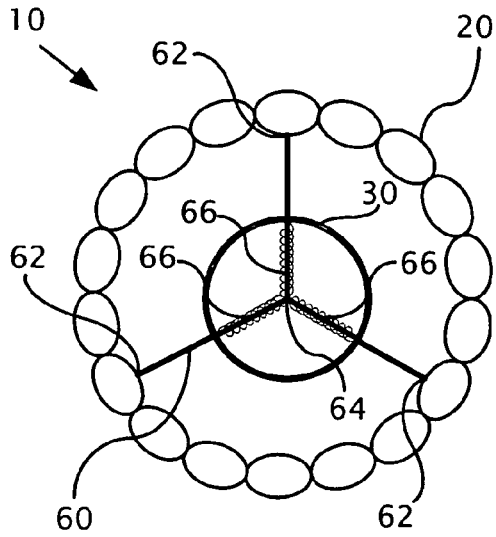
FIG. 4 is a cross-sectional view of the main-body portion in FIG. 1 illustrating a second representative embodiment of a support structure for supporting the inner tube within the outer tube.
Figure 5:
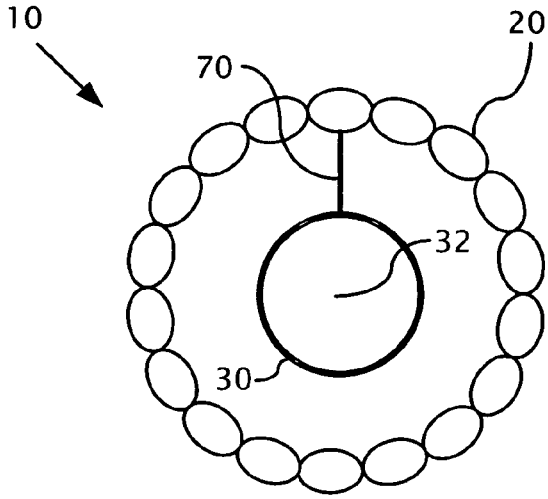
FIG. 5 is a cross-sectional view of the main-body portion in FIG. 1 illustrating a third representative embodiment of a support structure for supporting the inner tube within the outer tube.

In the embodiments shown in FIGS. 1 and 2, the inner tube 30 may be held in position within the outer tube 20 by a variety of different means. For instance, a support structure may be placed at regular intervals, or continuously, along the length of the outer tube 20 and maintain the proper alignment of the inner tube 30 within the outer tube. The support structure may be made from various rigid or semi-rigid materials (e.g., plastic) and may be affixed to the inner surface of the outer tube. FIGS. 3-5 show several possible designs for such support structures. FIG. 3, for instance, shows an exemplary triangular support structure 50 that is affixed to the outer tube 20 at three substantially equidistant points 52 along the circumference of the outer tube. The inner tube 30 is then positioned within the interior of the triangular support structure 50, and may be affixed to the support structure via an adhesive or other suitable means. FIG. 4 shows an exemplary support structure 60 having three posts that affix to the inner surface of the outer tube 20 at three equidistant points 62. The three support posts of the structure 60 pass through the surface of the inner tube 30 and are joined at a common center point 64. Springs 66 may be disposed around the portion of the posts in the inner-tube passage 32. The springs 66 can then exert a radial force on the interior surface of the inner tube 30 that maintains the shape and proper diameter of the inner tube. FIG. 5 shows an exemplary support flange 70 that is connected to the inner surface of the outer tube 20 and connects with the outer surface of the inner tube 30. The support flange 70 may be made of a rigid or semi-rigid material (e.g., plastic), but may also be made from a flexible material (e.g., a polymer sheet). These illustrated configurations should not be construed as limiting in any way, however, as various other support structures are possible (e.g., a helical wire support).

Figure 6:
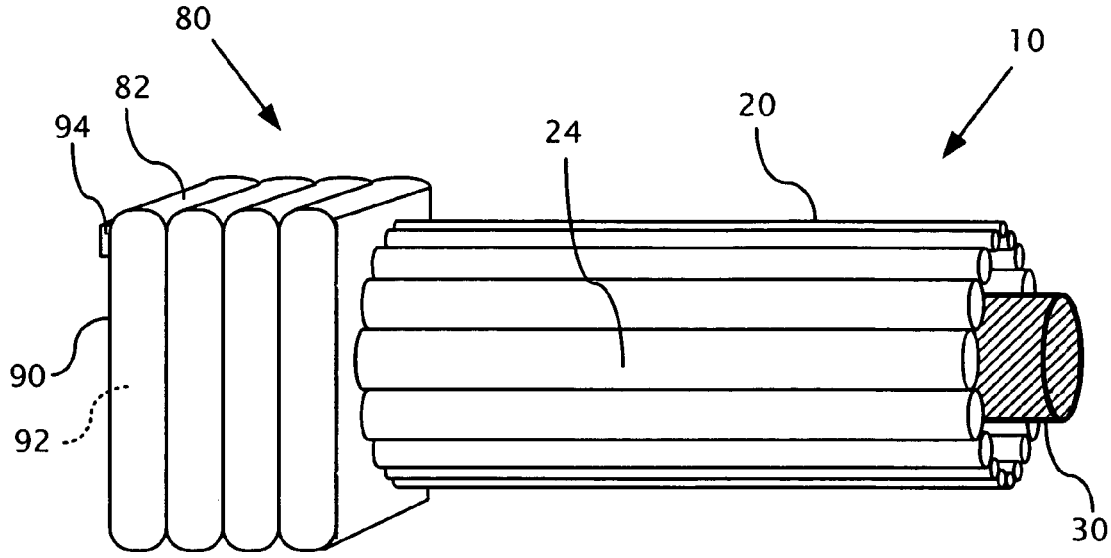
FIG. 6 is a first perspective view of the main-body portion in FIG. 1 coupled to an exemplary collar portion.
Figure 7:
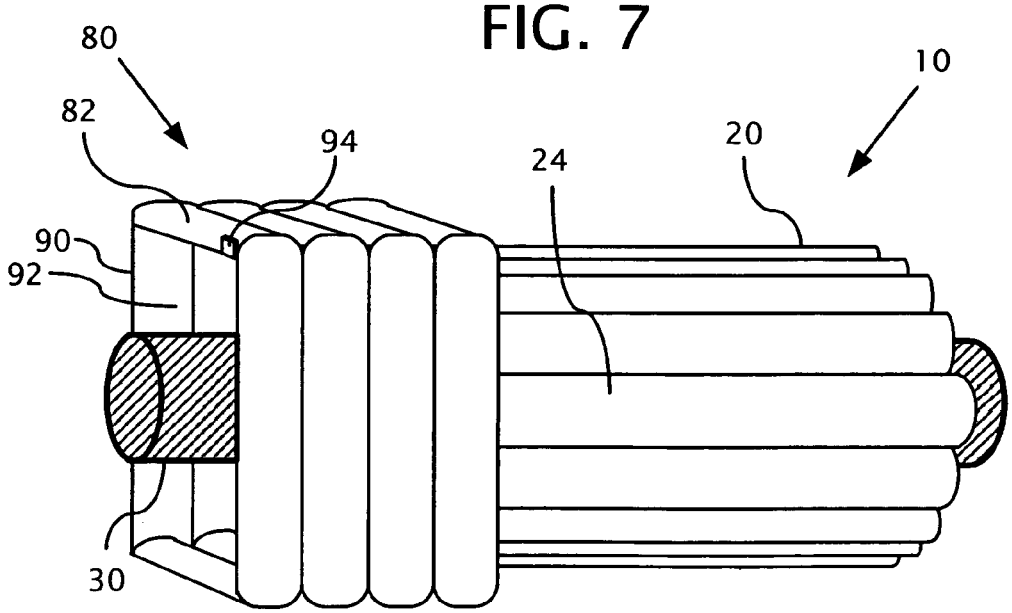
FIG. 7 is a second perspective of the main-body portion and collar portion of FIG. 6.
Figure 8:
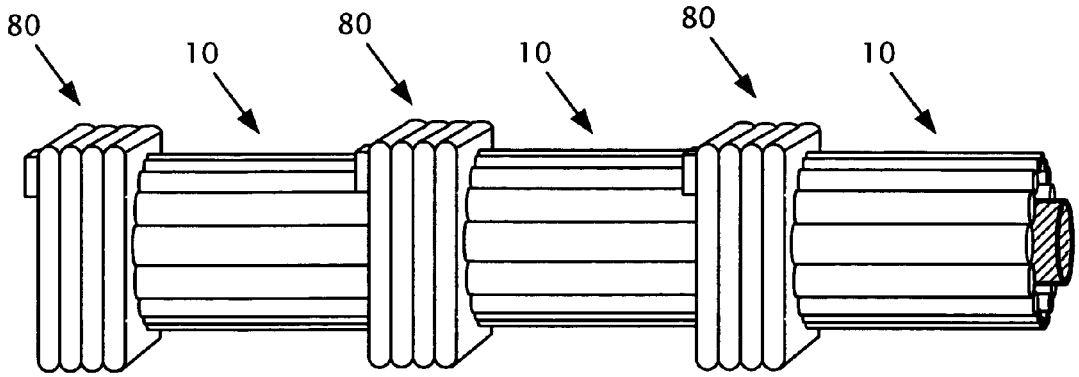
FIG. 8 is a perspective view of multiple main-body portions according to the embodiment illustrated in FIG. 1 coupled together via respective collar portions.

As shown in FIG. 6, the main-body portion 10 of the heat exchanger may also be attached to a collar portion 80 in certain embodiments. In the illustrated embodiment, the collar portion 80 is used to lend additional support to the cylindrical outer tube 20. The collar portion 80 may also be used as a manifold to connect the main-body portion 10 to an air source (e.g., an HVAC unit) or to multiple other main-body portions 10 at a junction. In the embodiment shown in FIG. 6, the collar portion 80 comprises multiple inflatable collar cells 82 that are oriented perpendicularly to the cells 24 and define a rectangular solid shape when inflated. This shape, however, is not limiting, as the collar (or manifold) may be configured in a variety of forms (e.g., cylindrical, oval, etc.). As illustrated by FIG. 7, the collar portion 80 is open at a distal end 90, which defines a hollow interior 92. In the embodiment illustrated in FIG. 7, the inner tube 20 extends into the hollow interior 92. The hollow interior 92 may be adapted to couple with a main-body portion 10 such that adjacent outer-tube passages and inner-tube passages are fluidly coupled. Thus, as is illustrated in FIG. 8, multiple main-body portions 10 and collar portions 80 may be coupled together to form a heat exchanger of any length. The relative lengths of the main-body portions 10 and the collar portions 80 shown in FIG. 8, however, are for illustrative purposes only and are not limiting in any way. The actual lengths of the main-body portions may, for instance, be substantially longer.

In certain embodiments, and as illustrated by FIG. 7, the inflatable cells 24 of the main-body portion 10 may be fluidly coupled to at least one of the collar cells 82 in the collar portion 80. Thus, as air passes into the collar cells 82, the cells of the outer tube 10 are also inflated. In this embodiment, then, the collar portion 80 serves as a manifold that regulates air to the inflatable cells 24 of the outer tube 10. The passage of air into the collar portion may be further regulated by a one-way valve 94, such as a one-way valve used in conventional air mattress. The one-way valve 94 may be positioned at the distal end 90 of the collar portion 80 and fluidly coupled to an air source (e.g., an HVAC fan or air pump) or to one or more of the cells of an adjacent main-body portion. The one-way valve 94 operates to allow inflation of the collar portion 80 and the outer tube 20 upon activation of the air source. The one-way valve 94 also prevents deflation of the portions 20, 80 once the air source is deactivated or disconnected.

In one particular embodiment, for example, when the heat exchanger having inflatable main-body portions 10 and one or more collar portions 80 is first installed into a ventilation system, it may be deflated. Once the system is activated, however, the main-body portions 10 and collar portions 80 inflate to assume their cylindrical form and, because of the one-way valve 94, will maintain their shape after the system is shut down. If the heat exchanger is not used for a long period of time, the main-body portions 10 and the collar portion 80 may lose some of its internal pressure and partially deflate. Once the ventilation is reactivated, however, the heat exchanger will reinflate to its full shape.

Figure 9:
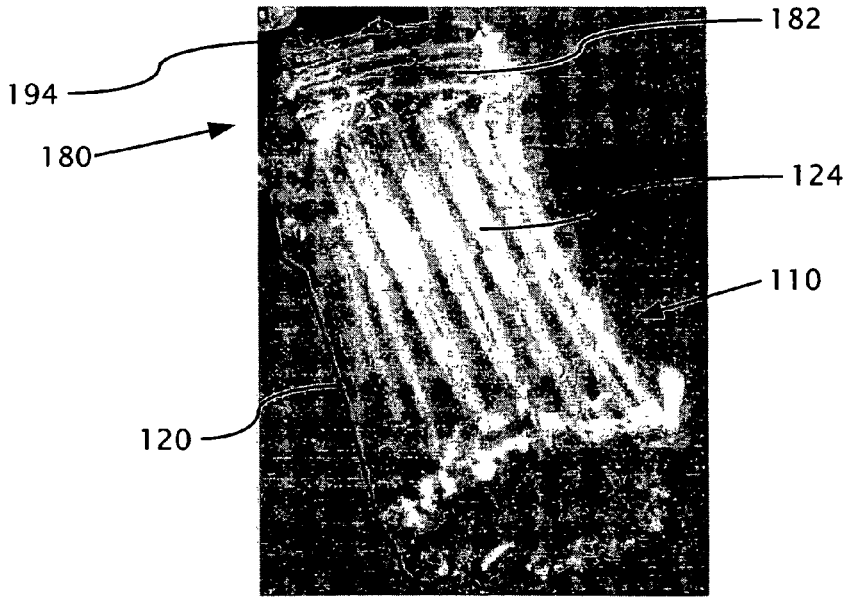
FIG. 9 is a photographic image showing an exemplary outer tube and collar portion.

FIG. 9 is an image of an exemplary main-body portion 110 and collar portion 180. As seen in FIG. 9, an outer tube 120 is formed of multiple inflatable cells 124. A collar portion 180 includes multiple collar cells 182 and is integrally coupled to the outer tube 120. A one-way valve 194 coupled with the collar portion 180 is also shown.

Figure 10:
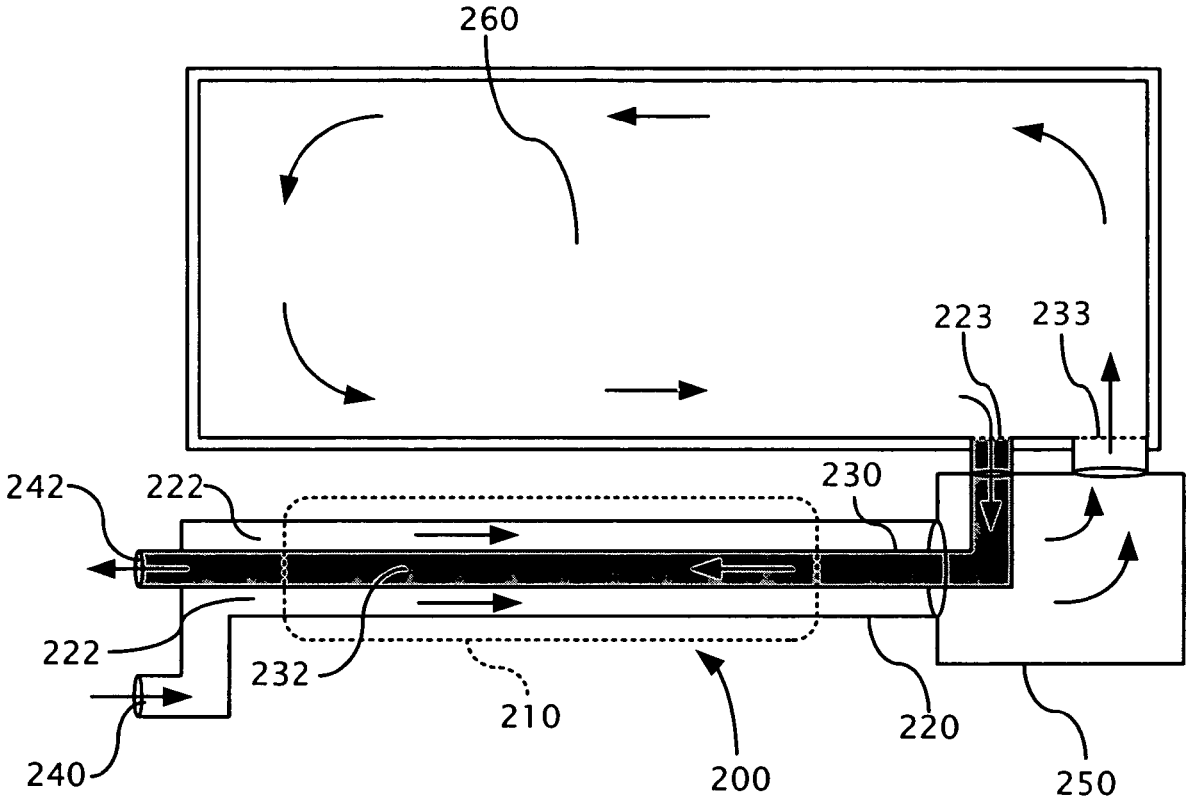
FIG. 10 is a diagram schematically illustrating operation of an exemplary heat exchanger.

FIG. 10 is a schematic diagram showing an exemplary heat exchanger 200 having a main-body portion 210, which may constructed according to any one of the embodiments discussed above. As more fully described above, the heat exchanger 200 has an outer tube 220, an outer-tube passage 222, an inner tube 230, and an inner-tube passage 232. In the embodiment shown in FIG. 1, the outer-tube passage 222 is configured to transport fresh air from an inlet 240 (e.g., an inlet from the outside environment). Further, the inner-tube portion 232 is configured to transport exhaust air to an outlet 242 (e.g., an outlet to the outside environment, which may be displaced somewhat from the inlet 240 to limit unintended recycling). Moreover, in the illustrated embodiment, the main-body portion 210 is coupled with an air source 250. The air source may comprise, for example, an HVAC unit configured to heat, cool, or otherwise condition the inlet air in the inner-tube passage 232. Further, the air source 250 may be configured to maintain an airflow (illustrated by the arrows in the heat exchanger 200) in either one or both of the inner-tube passages 232 or outer-tube passages 222. The air source 250 may further include a fan, pump, or other inflation unit that is coupled to a one-way valve on the outer tube 220 and that is configured to inflate the cells of the outer tube. The air source may further couple the outer-tube passage 222 and the inner-tube passage 232 to an interior space 260 via vents 223, 233, respectively. The interior space 260 may comprise, for example, a residential home or business space. Further, the vents 223, 233 may comprise multiple vents and may be located in a multitude of different locations within the interior space 260.

In one particular application, a heat exchanger according to any one of the disclosed embodiments is positioned in an underutilized area of a building. For example, the heat exchanger may be located in an unused crawlspace, attic, rooftop, ventilation space, or basement, thereby increasing the amount of surface area available for heat exchange. Because certain embodiments of the heat exchanger are constructed from highly economical materials, and because the flexibility of certain embodiments allows the heat exchanger to be used in a variety of different spaces, the length and volume of the disclosed heat exchanger may exceed the length and volume of conventional heat exchangers. For example, the following tables show a structural comparison of an exemplary heat exchanger as described herein to a number of conventional heat exchangers. The exemplary heat exchanger referenced in the tables comprises a main-body portion as illustrated in FIG. 1 and discussed above. Further, the exemplary heat exchanger has a length of 100 feet and a passage height of 6 inches. The conventional heat exchangers to which the exemplary heat exchanger is compared comprise various models sold under the VänEE® brand name and manufactured by Venmar® Ventilation, Inc.

TABLE 1

Comparison of Exchange Areas Among Heat Exchangers

| Manufacturer and Model | Core Volume ($in^3$) | Core Volume ($ft^3$) | Exchange Area ($ft^2$) | Exchange Area/ Volume ($in^2/in^3$) | Exchange Area/ Volume ($ft^2/ft^3$) |
|---|---|---|---|---|---|
| Exemplary Heat Exchanger | 60318.6 | 34.9 | 209.4 | 0.5 | 6 |
| Venmar/VänEE 1.3HE or 1000 HE | 2197 | 1.27 | 144 | 9.44 | 113.26 |
| Venmar/VänEE 1.8HE or 2000 HE | 6037.5 | 3.49 | 184 | 4.39 | 52.66 |
| Venmar/VänEE 2.6HE or 3000 HE | 6037.5 | 3.49 | 184 | 4.39 | 52.66 |
| Venmar/VänEE 190H Bronze Series | 2604 | 1.51 | 102 | 5.64 | 67.69 |
| Venmar/VänEE 1001 ERV | 1854 | 1.07 | 116 | 9.01 | 108.12 |
| Venmar/VänEE 2001 ERV | 2412 | 1.4 | 156 | 9.31 | 111.76 |
| Venmar/VänEE AVS Solo 1.5 | 2604 | 1.51 | 102 | 5.64 | 67.69 |

TABLE 2

Comparison of Heat Exchanger Dimensions

| Manufacturer and Model | Path Length (in) | Path Length (ft) | Passage Height (in) | Path Length Increase of Exempl. Heat Exchanger | Passage Ht. Increase of Exempl. Heat Exchanger |
|---|---|---|---|---|---|
| Exemplary Heat Exchanger | 1200 | 100 | 6 | | |
| Venmar/VänEE 1.3HE or 1000 HE | 13 | 1.08 | 0.106 | 9131% | 5563% |
| Venmar/VänEE 1.8HE or 2000 HE | 15 | 1.25 | 0.228 | 7900% | 2533% |
| Venmar/VänEE 2.6HE or 3000 HE | 15 | 1.25 | 0.228 | 7900% | 2533% |
| Venmar/VänEE 190H Bronze Series | 12 | 1 | 0.177 | 9900% | 3284% |
| Venmar/VänEE 1001 ERV | 12 | 1 | 0.111 | 9900% | 5306% |
| Venmar/VänEE 2001 ERV | 12 | 1 | 0.107 | 9900% | 5488% |
| Venmar/VänEE AVS Solo 1.5 | 12 | 1 | 0.177 | 9900% | 3284% |

As can be seen from Tables 1 and 2, the exemplary heat exchanger has a substantially greater path length and passage height compared to the conventional heat exchangers (e.g., 1200 inches compared to 1-1.25 feet for path length, and 6 inches compared to 0.106-0.228 inches for passage height). Moreover, the core volume of the exemplary heat exchanger is substantially greater than the core volume of the conventional heat exchangers (e.g., 34.9 $feet^3$ compared to 1.07-3.49 $feet^3$). As can also be seen from Table 1, the exchange area of the exemplary heat exchanger is only somewhat greater than the other heat exchangers despite the path length for the exemplary heat exchanger being substantially greater. Table 1 also shows that although the exchange area of the exemplary heat exchanger is not drastically larger than conventional heat exchangers, the exchange area per unit of volume of the exemplary heat exchanger is substantially smaller in comparison to the conventional heat exchangers (e.g., 6 $ft^2/ft^3$ compared to 52.66-113.26 $ft^2/ft^3$). Finally, Table 2 shows that the passage height of the exemplary heat exchanger is substantially greater than the conventional heat exchangers.

Figure 11:
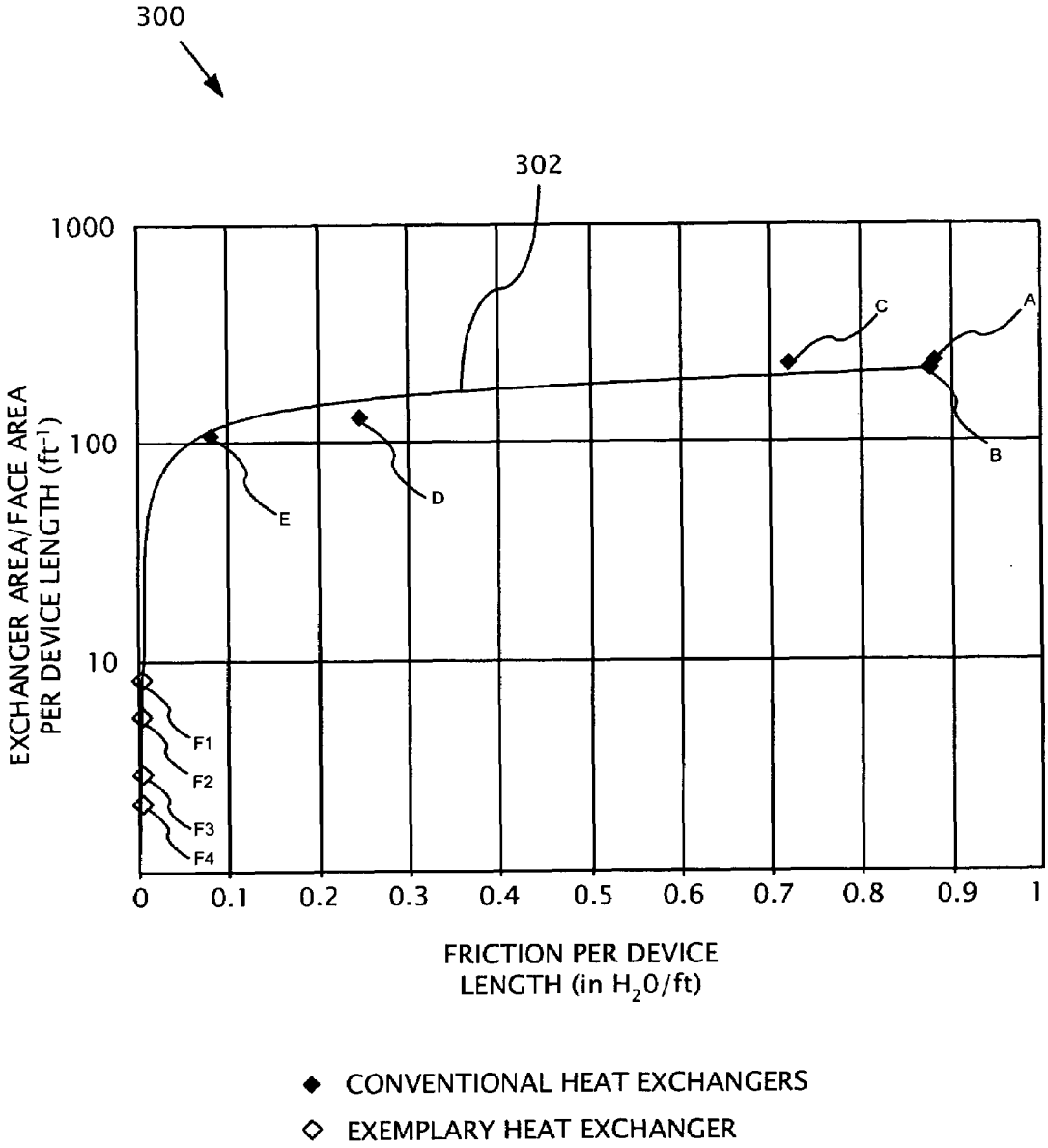
FIG. 11 is a first graph illustrating physical differences between conventional heat exchangers and a representative embodiment of the disclosed heat exchanger.
Figure 12:
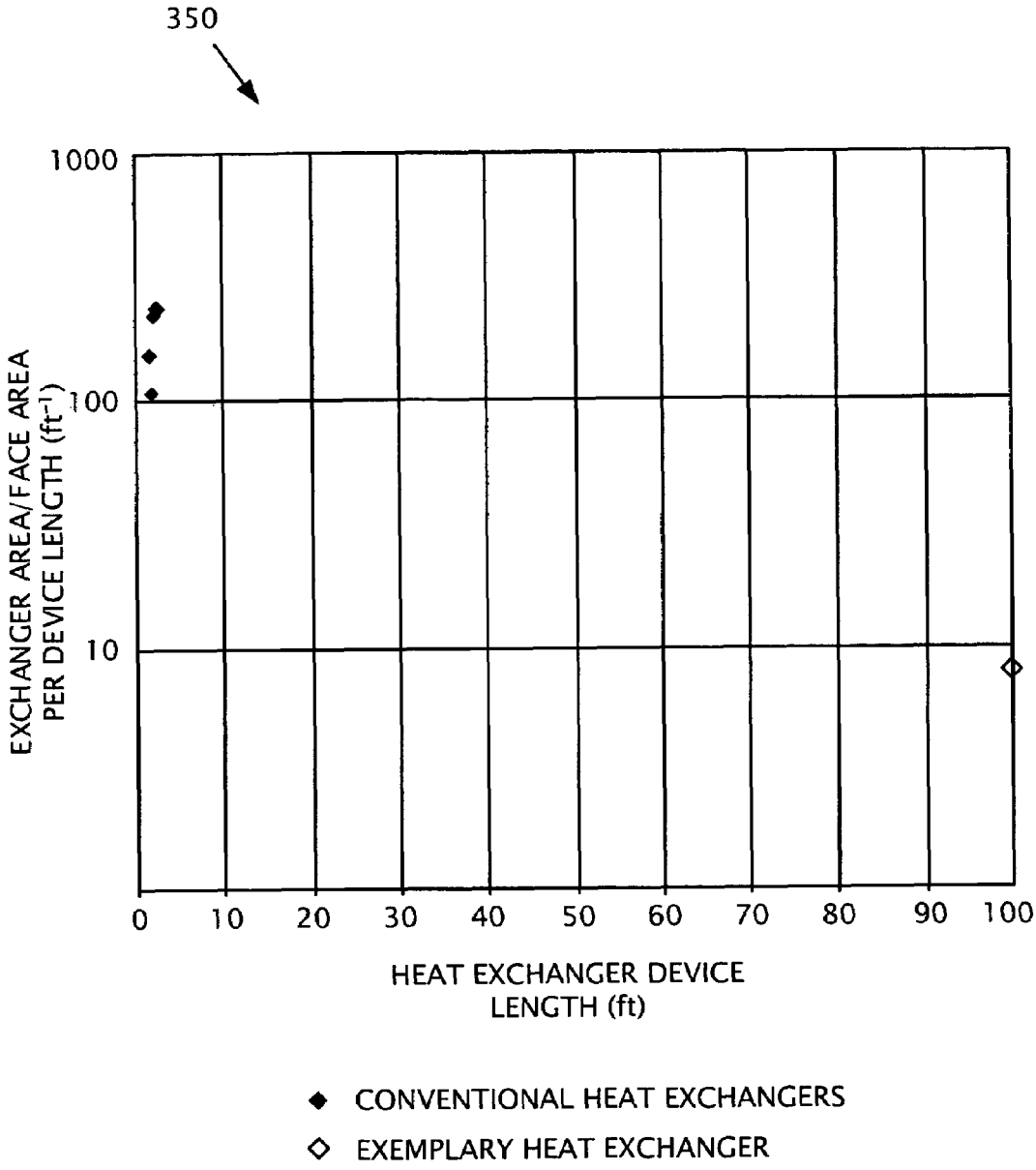
FIG. 12 is a second graph illustrating physical differences between conventional heat exchangers and a representative embodiment of the disclosed heat exchanger.
Figure 13:
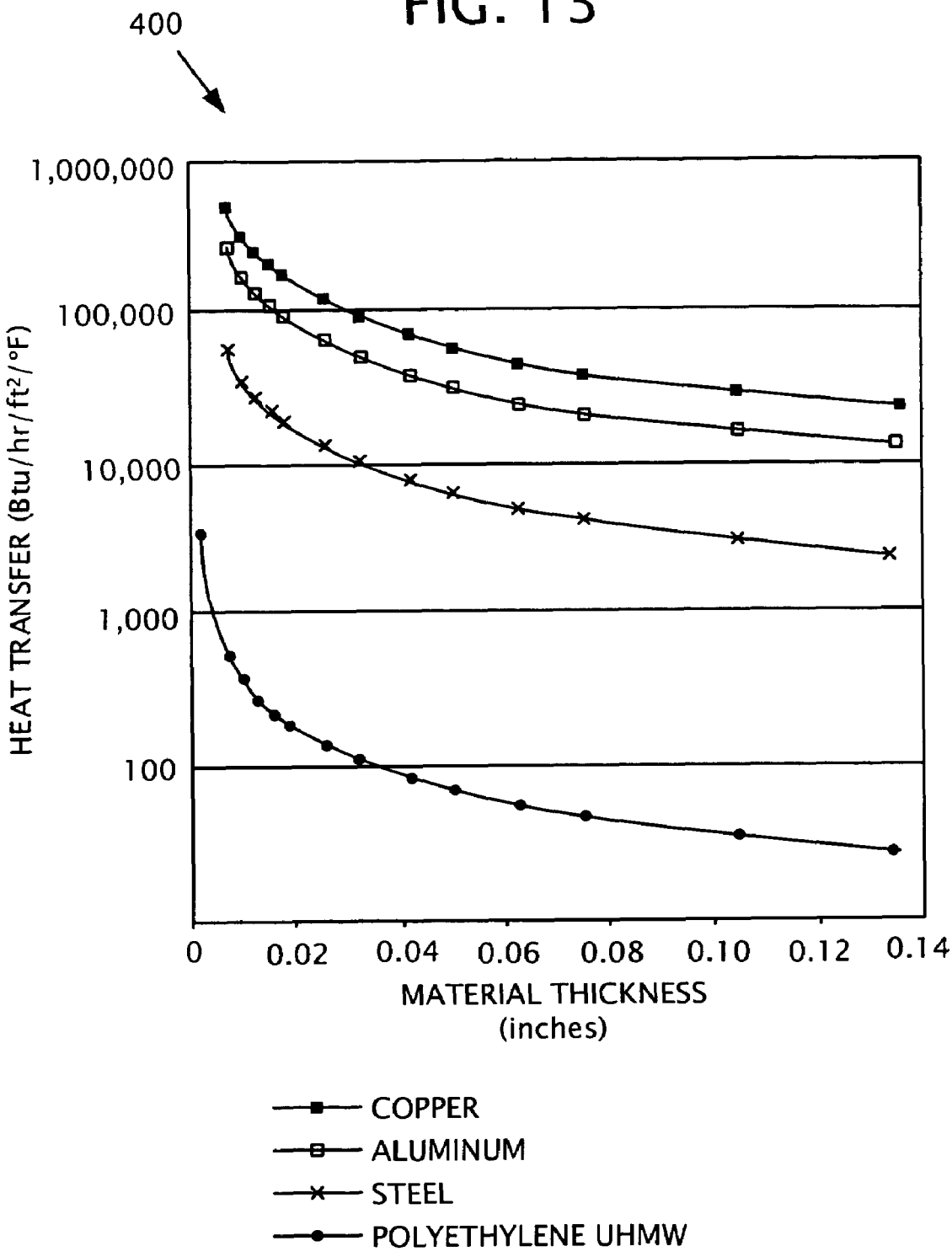
FIG. 13 is a third graph illustrating differences between the coefficient of heat transfer for a variety of materials.

FIGS. 11-13 illustrate some of the physical characteristics that can be exhibited, alone or in combination with one another, by exemplary heat exchangers manufactured according to the disclosed technology. In particular, FIG. 11 shows a graph 300 measuring the heat-exchange-area/face-area-per-device-length (measured in $ft^{-1}$) versus the friction per device length (measured in inches of water per length of the device) for four exemplary heat exchangers of various path lengths and for a number of conventional heat exchangers.

The heat exchange area is defined as the area of the surface in the heat exchanger where the actual exchange of heat occurs (that is, the area of the surface separating the two (or more) regions of the exchanger across which heat is transferred). The face area per device length is defined as the inlet area of the air flow into the heat exchanger divided by the length of the heat exchanger.

Tabulated below in Table 3 are the data points for the conventional heat exchangers (A-E) and the exemplary heat exchangers (F1-F4) shown in FIG. 11.

TABLE 3

FIG. 3 Data Points

| Data Point | Device(s) | Friction per device length (in $H_2O$/ft) | Exchanger Area/Face Area per device length | Path Length (ft) |
|---|---|---|---|---|
| A | Venmar/VänEE 1.3HE 1000 HE | 0.88 | 226.5 | 1.08 |
| B | Venmar/VänEE 1001 ERV | 0.88 | 216.2 | 1 |
| C | Venmar/VänEE 2001 ERV | 0.72 | 223.5 | 1 |
| D | Venmar/VänEE 190 H Bronze Series AVS Solo 1.5 | 0.25 | 135.4 | 1 |
| E | Venmar/VänEE 1.8 HE 2000 HE 2.6 HE 3000 HE | 0.08 | 105.3 | |
| F1 | Prototype 1 | 0.002625 | 8 | 100 |
| F2 | Prototype 2 | 0.003282 | 6 | 80 |
| F3 | Prototype 3 | 0.004338 | 4 | 60 |
| F4 | Prototype 4 | 0.005250 | 3 | 50 |

As can be seen from the graph 300, the exemplary heat exchangers in this specific example exhibit substantially less friction than the conventional heat exchangers, thereby decreasing the load on the ventilation system driving the heat exchanger.

Also shown in graph 300 is a curve 302 that is fit to the data to show the trend of the friction measurement. In general, certain embodiments of the disclosed heat exchanger have an exchanger area/face area per device length less than or substantially equal to 99 $ft^{-1}$. Further, certain embodiments of the disclosed heat exchanger have a flow friction substantially equal to or less than 0.05 inches of water per one-hundred feet of heat-exchanger path length.

This lower total friction, while usually observed for embodiments of the new heat exchanger, is not a requirement, and the total friction may in fact be higher than for conventional systems if the new heat exchanger has dimensions outside these specific examples.

FIG. 12 shows a similar graph 350, but measures the heat-exchange-area/face-area-per-device-length versus the device length for the exemplary embodiment of the heat exchanger and the various conventional heat exchangers described above. As can be seen in FIG. 12, the device length of the exemplary embodiment is substantially larger than that of the conventional heat exchangers. In general, the disclosed heat exchangers can be manufactured to be of any length, but will ordinarily have a path length substantially longer than conventional heat exchangers. The additional length, for example, may be used to compensate for the heat exchange surface having a lower coefficient of heat transfer than in conventional heat exchangers or to compensate for the low flow friction exhibited by embodiments of the disclosed technology. Typically, the cost per unit of length of the disclosed heat exchangers is much lower than that of conventional heat exchangers. Thus, manufacturing a heat exchanger of substantial length using the disclosed technology is not cost prohibitive and can provide a low-cost alternative to expensive, conventional heat exchangers.

The dimensions of the exemplary heat exchanger used to construct Tables 1 and 2 and FIGS. 11-12 are for illustrative purposes only and should not be construed as limiting in any way. Instead, the dimensions of the heat exchanger may vary depending on the particular application for which it is used.

FIG. 13 shows the coefficient of heat transfer (measured in Btu/(hr·ft$^2$·° F.)) versus the material thickness (measured in inches) for a variety of materials. Conventional heat exchangers generally use materials having a relatively high coefficient of heat transfer for the heat exchange surface. For example, conventional heat exchangers typically use metals such as aluminum, copper, and steel as the heat exchanger surface. By contrast, certain embodiments of the disclosed heat exchanger use less expensive materials for the heat exchange surface that typically have a substantially lower coefficient of heat transfer. For example, and as noted above, the heat exchange surface in some embodiments of the disclosed heat exchanger may be manufactured from ultra-high molecular-weight (UHMW) polyethylene. The graph 400 shows that UHMW polyethylene has a heat transfer coefficient that is at least an order of magnitude less than the other materials shown in FIG. 13. Despite the lower coefficient of heat transfer, comparable or better heat exchange can be realized by embodiments of the disclosed heat exchangers in comparison with the conventional heat exchangers on account of the large sizes to which the heat exchangers can be manufactured. Moreover, embodiments of the disclosed technology are highly flexible and can be inserted into almost any unused space within a building or house, allowing its relatively large size to be hidden from view and to not substantially affect new construction designs. Further, because of the flexibility that is allowed in these embodiments, the heat exchanger surface can be relatively thin, thereby increasing its coefficient of heat transfer.

Figure 14:
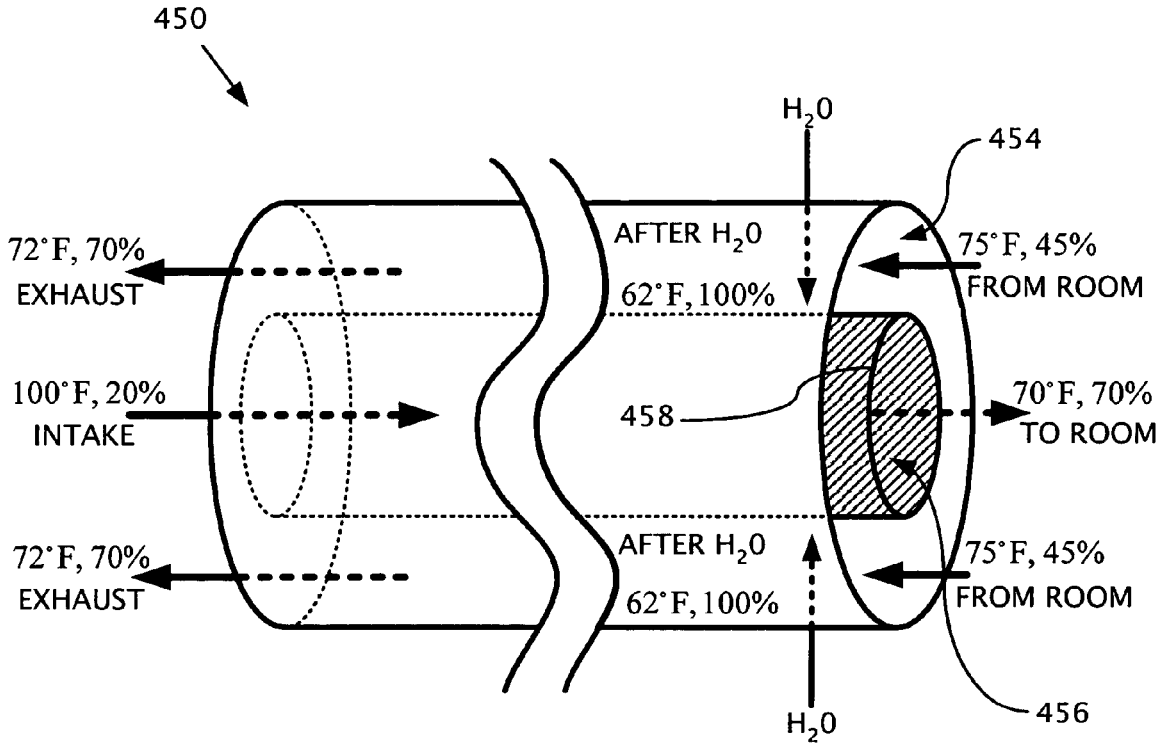
FIG. 14 is a first block diagram schematically illustrating an embodiment of a representative heat exchanger that utilizes additional moisture introduced to the air in the outer passage of the heat exchanger.

Any of the embodiments of the disclosed heat exchanger may be used with other ventilation and/or air treatment techniques in order to obtain certain desirable results. For example, in certain implementations, the disclosed heat exchanger is operated in connection with a system that introduces moisture into the inlet and/or outlet air flows. An example of the operation of a representative embodiment of the disclosed heat exchanger in which additional moisture is introduced is schematically illustrated in FIG. 14. In particular, FIG. 14 shows an embodiment of a counterflow heat exchanger 450 according to the disclosed technology that includes a mechanism (shown as the arrows marked "$H_2O$") for introducing moisture into the outer passage 454 at or near the end of the heat exchanger at which exhaust air from a room or building is inlet into the exchanger. The mechanism may, for example, comprise misting jets or wetted pads, such as those used in evaporative coolers. Assume for purposes of FIG. 14 that the heat exchange surface 458 between the outer passage 454 and an inner passage 456 is constructed of a material that transmits sensible and latent heat (e.g., a vapor-permeable material such as Tyvek®). As the moisture is introduced into the outer passage 454, the relative humidity of the exhaust air increases from 45% to 100%, and the temperature decreases from 75° F. to 62° F. Then, as this column of air propagates through the heat exchanger, sensible and latent heat is transferred across the exchange surface 458, thereby decreasing the temperature and increasing the humidity of the air being transferred through inner passage 456. In this example, the intake air from the outside originally has a temperature of 100° F. and a relative humidity of 20% (e.g., representative of a typical summer day in a low-humidity region). After being transported through the heat exchanger 450, the air temperature has been decreased to 70° F. and the relative humidity has been increased to 70%. The air in the inner passage 456 may then, for example, be further conditioned by an HVAC unit (in which case the load on the HVAC unit is greatly reduced as a result of the preconditioning of the air in the heat exchanger), otherwise treated, or simply supplied into the desired room(s) of the house or building.

Figure 15:
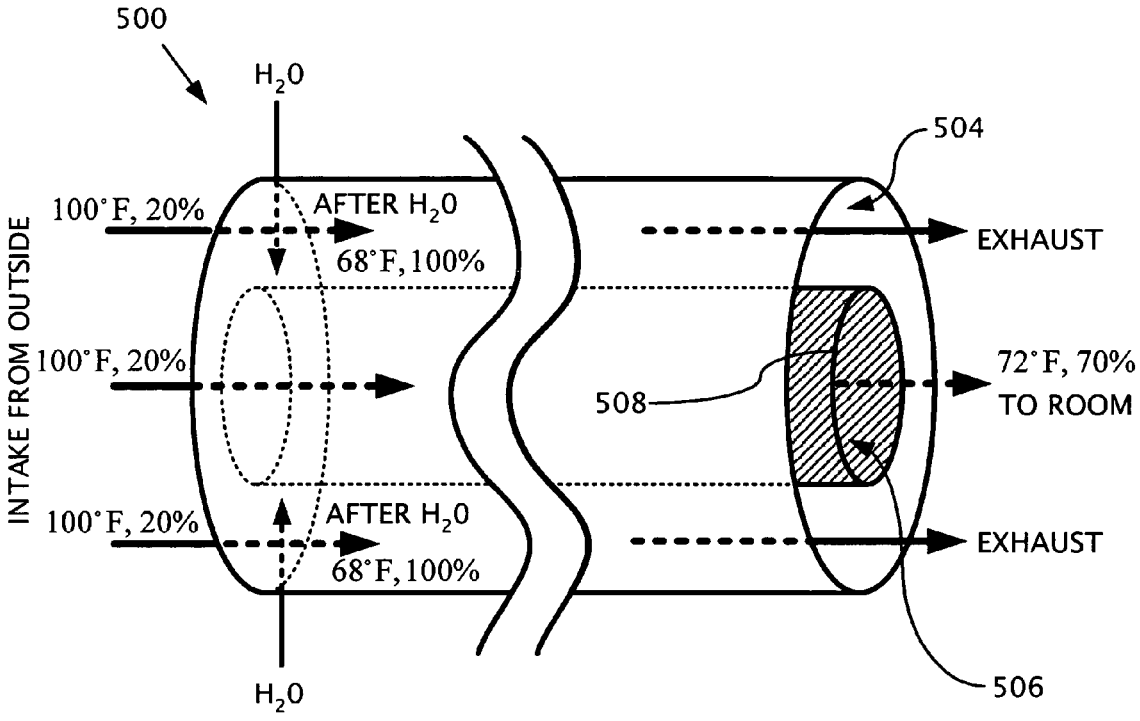
FIG. 15 is a second block diagram schematically illustrating an embodiment of a representative heat exchanger that utilizes additional moisture introduced to the air in the outer passage of the heat exchanger.

FIG. 15 shows a schematic illustration similar to that of FIG. 14 for an exemplary parallel flow heat exchanger. In FIG. 15, the heat exchanger 500 intakes air from outside into both the outer passage 504 and the inner passage 506. In this example, the intake air from the outside originally has a temperature of 100° F. and a relative humidity of 20% (e.g., representative of a typical summer day in a low-humidity region). Moisture is introduced into the outer passage by a mechanism at or near the inlet end of the heat exchanger 500. After introduction of the moisture into the air, the temperature of the air in the outer passage has decreased to 68° F. and the relative humidity has increased to 100%. As the air propagates through the heat exchanger, sensible and latent heat is exchanged across the heat exchanger surface 508, thereby decreasing the temperature and increasing the humidity of the column of air in the interior passage 506. At the other end of the heat exchanger 500, the air from the inner passage 506 in this example has been decreased to 72° F. and its relative humidity increased to 70%. The air can then be further conditioned or supplied to the interior of a building or house.

In view of the many possible embodiments to which the principles of the invention may be applied, it should be recognized that the illustrated embodiments are only representative examples of the invention and should not be taken as a limitation on the scope of the invention. Rather, the scope of the invention is defined by the following claims. We therefore claim as our invention all that comes within the scope of the claims.

What is claimed is:

1. A method of utilizing unused space within or adjacent a building for exchanging heat, comprising:

providing a tube-in-tube heat exchanger with inner and outer tubes, the outer tube being formed of multiple inflatable air cells;

connecting an end of the inner tube to one of either an inlet of a ventilation system for the building or an outlet of the ventilation system for the building;

connecting an end of the outer tube to the other of either the outlet of the ventilation system or the inlet of the ventilation system; and inflating the air cells of the tube-in-tube heat exchanger in an unused space in the building.

2. The method of claim 1, wherein the connecting the end of the outer tube further includes connecting a valve fluidly coupled to the multiple air cells to the outlet of the ventilation system.

3. The method of claim 2, wherein the valve is a one-way air valve.

4. The method of claim 1, wherein the unused space is an attic.

5. The method of claim 1, wherein the unused space is a crawlspace.

6. The method of claim 1, wherein the outer tube is constructed of a nonpermeable material, and the inner tube is constructed of a vapor-permeable membrane or a nonpermeable material.

7. The method of claim 1, wherein the inflatable air cells of the outer tube are inflated each time the ventilation system is activated.

8. The method of claim 1, wherein a smallest dimension in a cross-section of the inner tube is at least two inches when the inner tube is inflated.

9. The method of claim 1, wherein the inner tube is positioned substantially concentrically within the outer tube.

10. The method of claim 9, wherein the inner tube is supported within the outer tube by a support structure.

11. The method of claim 1, wherein the ventilation system is a heating, ventilation, and air-conditioning (HVAC) system.

* * * * *

UNITED STATES PATENT AND TRADEMARK OFFICE

CERTIFICATE OF CORRECTION

PATENT NO. : 7,624,788 B2
APPLICATION NO. : 10/999604
DATED : December 1, 2009
INVENTOR(S) : Brown et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1147 days.

Signed and Sealed this

Twenty-sixth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,624,788 B2
APPLICATION NO. : 10/999604
DATED : December 1, 2009
INVENTOR(S) : Brown et al.

It is certified that error appears in the above-identified patent and that said Letters Patent is hereby corrected as shown below:

Cover Page, item [56] under OTHER PUBLICATIONS, page 2,
"http://eisg.sdsu.edu/..\Fullsums\99-24.htm" should be --http://eisg.sdsu.edu/Fullsums/99-24.htm--.

Column 5,
Line 65, "dependant" should be --dependent--.

Column 6,
Line 20, "produces" should be --produce--.

Column 7,
Lines 44, 46, "outer tube 10" should be --outer tube 20--.

Column 8,
Line 2, "its" should be --their--.
Line 16, "may constructed" should be --may be constructed--.
Line 19, "FIG. 1" should be --FIG. 10--.

Signed and Sealed this
Thirteenth Day of September, 2011

David J. Kappos

David J. Kappos
*Director of the United States Patent and Trademark Office*